US005860837A

United States Patent [19]

Böck et al.

[11] Patent Number: 5,860,837

[45] Date of Patent: Jan. 19, 1999

[54] SPRING CLAMP TERMINAL

[75] Inventors: Werner Böck, Gross-Umstadt; Heinz-Peter Scherer, Bensheim; Sigrid Stolz, Alsbach-Hähnlein, all of Germany

[73] Assignee: The Whitaker Corporation, Wilmington, Del.

[21] Appl. No.: 927,119

[22] Filed: Sep. 5, 1997

Related U.S. Application Data

[63] Continuation of Ser. No. 626,866, Apr. 3, 1996, abandoned.

[30] Foreign Application Priority Data

Apr. 21, 1995 [GB] United Kingdom ..... 9508153

[51] Int. Cl.[6] ..... H01R 4/48

[52] U.S. Cl. ..... 439/828; 439/834

[58] Field of Search ..... 439/828, 829, 439/834

[56] References Cited

U.S. PATENT DOCUMENTS

| | | | |
|---|---|---|---|
| 1,357,926 | 11/1920 | Baldwin | 439/828 |
| 1,655,598 | 1/1928 | Diller | 439/828 |
| 4,171,861 | 10/1979 | Hohorst | 439/94 |
| 4,767,340 | 8/1988 | Hohorst | 439/828 |
| 4,768,981 | 9/1988 | Hohorst | 439/828 |
| 5,575,695 | 11/1996 | De Bernardis | 439/834 |

FOREIGN PATENT DOCUMENTS

| | | | |
|---|---|---|---|
| 27 06 482 | 8/1978 | Germany | H01R 4/48 |

*Primary Examiner*—Paula Bradley
*Assistant Examiner*—Tho D. Ta
*Attorney, Agent, or Firm*—Driscoll A. Nina; Anton P. Ness

[57] ABSTRACT

A spring clamp terminal for clamping connection to a conductor, comprises an anti-overstress member for preventing overstressing of the spring section of the terminal. Integral stamping and forming of the anti-overstress member from the spring clip provides a robust, cost-effective and reliable terminal.

10 Claims, 4 Drawing Sheets

SPRING CLAMP TERMINAL

This application is a Continuation of application Ser. No. 08/626,866 filed Apr. 3, 1996, now abandoned.

BACKGROUND OF THE INVENTION

1. Field of the Invention

This invention relates to a spring clamp terminal for electrical connection to a conductor by means of a resilient clamp, in particular a spring clamp terminal with an anti-overstress member to prevent overstressing of the spring.

2. Description of the Prior Art

Spring clamp terminals are known from DE 27 06 482, such spring clamps having a base member, and a U-shaped spring arm and actuation member that loops over the base and receives a leading edge of the base through a cutout in the actuation member. Upon depressing the actuation member, the cutout portion below the leading edge enlarges for receiving a conductor therethrough, the actuation member then being released such that the cutout is upwardly biased. A bottom edge of the cutout thus clamps the conductor against a lower surface of the base. One of the problems with this design is that the spring section can be overstressed. Although depression of the actuator is limited by an upper edge of the cutout abutting the base section, actuation of the spring member is typically made by inserting a tool such as a screwdriver tip in a housing cavity above the spring clamp to depress the actuator. The latter can cause overstressing of the spring element even though the actuator is limited in its depression, by pressing on the spring element itself. This problem has been recognized in U.S. Pat. No. 4,171,861 (for example see FIG. 12 of this patent) where a button 52 is moulded and positioned below the spring arm to prevent overbending thereof. The problem with this design is that a separate part is needed, or if the button is moulded directly with the housing, assembly becomes difficult and costly. Furthermore, an anti-overstress feature that is moulded out of plastic is not particularly resistant to damage.

SUMMARY OF THE INVENTION

It is therefore an object of this invention to provide a cost-effective spring clamp terminal with an anti-overstress feature to prevent excessive deformation of the spring portion thereof.

It is a further object of this invention to provide a spring clamp terminal with an anti-overstress feature that is robust and reliable, and yet cost-effective to manufacture and assemble to a connector housing.

The objects of this invention have been achieved by providing a screwless clamping terminal comprising a base section, spring section, actuation section and wire receiving section, the sections attached successively together and shaped such that the spring, actuation and wire receiving sections loop over the upper surface of the base section wherein the clamping terminal comprises an anti-overstress member integral therewith and positioned in a mid-section between the actuation and spring sections for limiting bending of the spring section, the anti-overstress member having a protrusion extending between the base section and actuation and spring sections. In one embodiment, the anti-overstress feature is a V-shaped bend situated between the actuation and spring members, directed towards the base, where the arms of the V-shape could be at an angle with each other of roughly 90°. Another embodiment has tabs bent substantially orthogonally from lateral edges of the base and projecting towards the spring arm. Another embodiment has tabs bent from the spring arm and directed towards the base.

DETAILED DESCRIPTION OF THE PREFERRED EMBODIMENT

Figure 1:
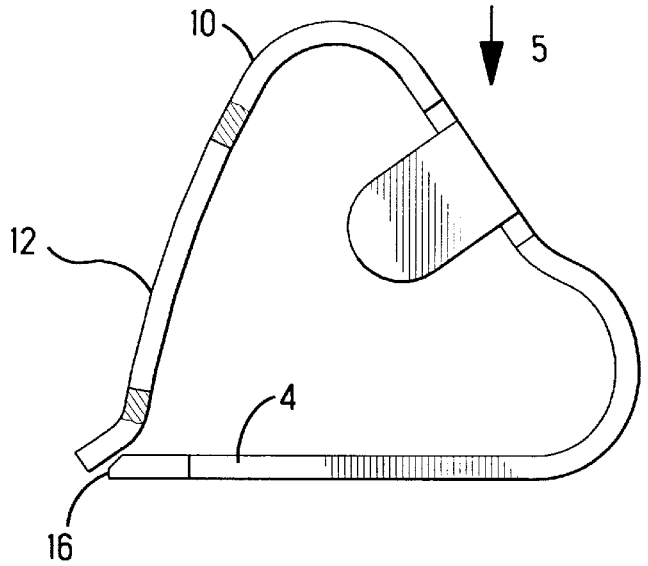
FIG. 1 is a side, partial cross-sectional view of an embodiment according to this invention in an unstressed state.
Figure 3:
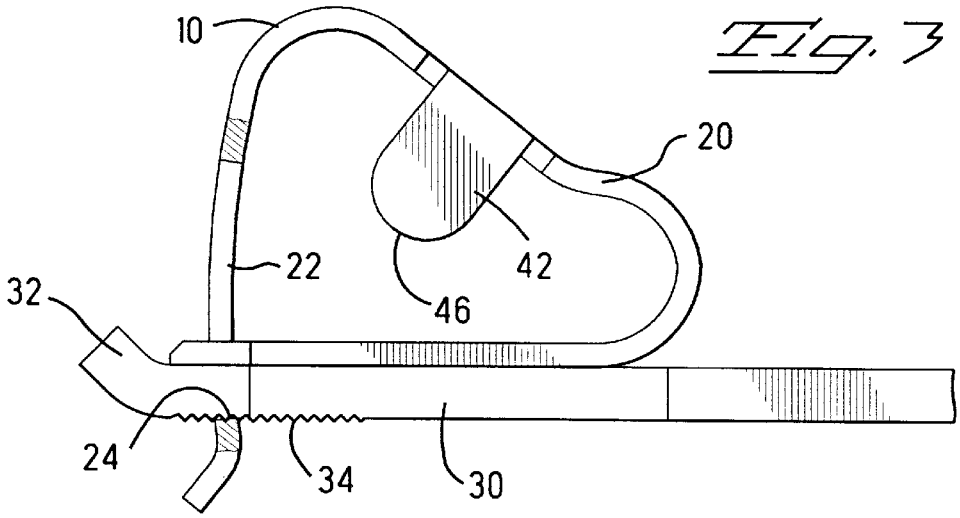
FIG. 3 is a similar view to that of FIGS. 1 and 2 but with a spring clamp mounted to a base plate.
Figure 4:
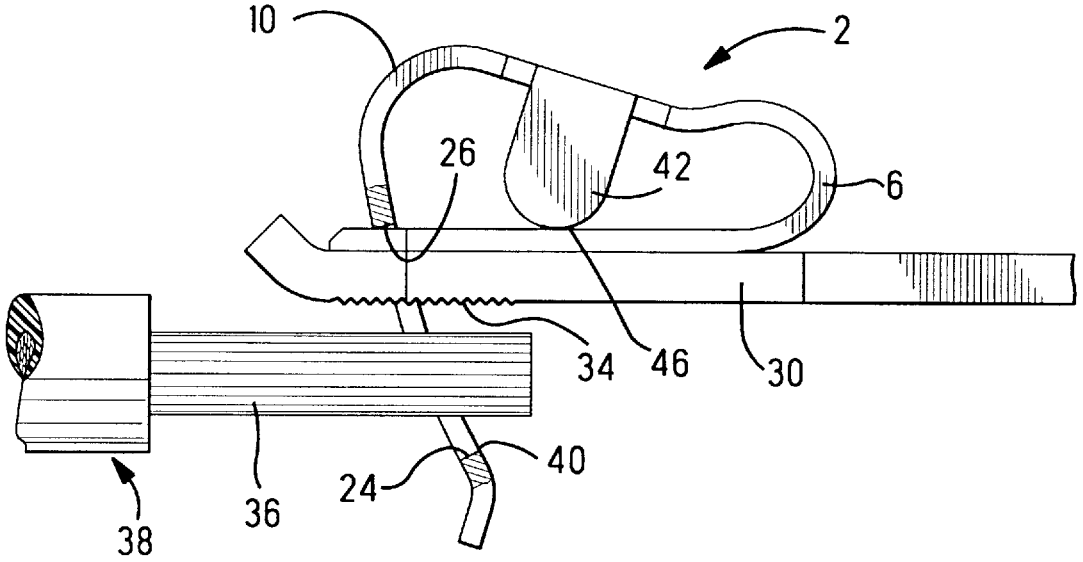
FIG. 4 is a view similar to that of FIG. 3 but with the spring element depressed and receiving a conducting wire.
Figure 5:
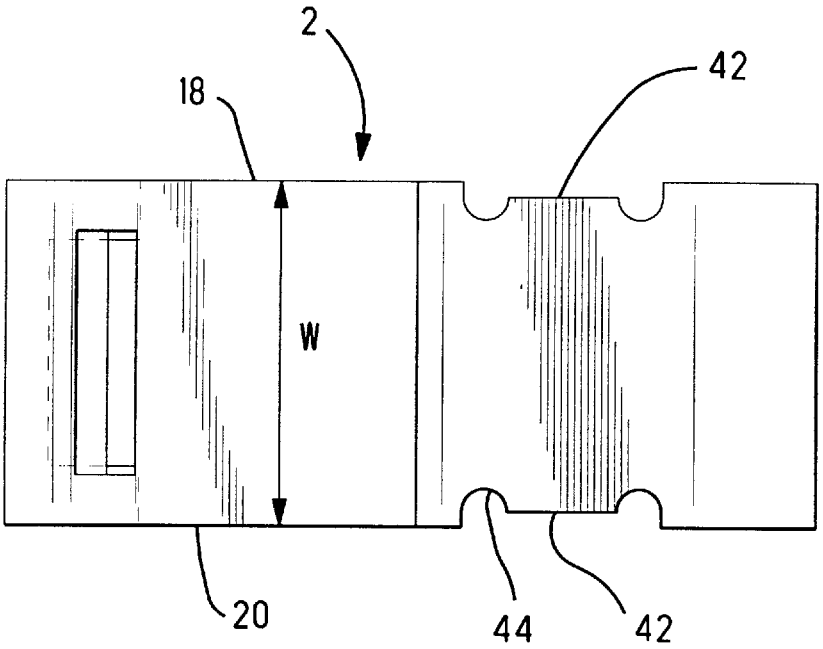
FIG. 5 is a top view of a terminal according to FIGS. 1–4.

Referring to FIGS. 1–5, a spring clamp terminal 2 is stamped and formed from sheet metal and comprises a substantially planar base section 4, a spring section 6 reversely folded from the base section into a substantially U-shape, further extending into an overhead lever arm section 8, further extending into an actuation section 10, which further extends into a conductor receiving section 12. The spring, lever arm, actuation and conductor receiving sections extend from the base section 4 in succession and loop thereover such that a free end 14 of the conductor receiving section 12 is positioned proximate a leading end 16 of the base section 4 remote from the spring section 6. In the initially formed state, the spring clamp has the disposition as shown in FIG. 1, where the conductor receiving section 12 is biased slightly apart from the leading end 16 of the base 4. As shown in FIG. 5, the spring clamp terminal 2 is folded from a long strip of sheet metal with roughly equal widths W of all of the sections 4–12, where lateral edges 18, 20 thereof are substantially parallel.

Figure 2:
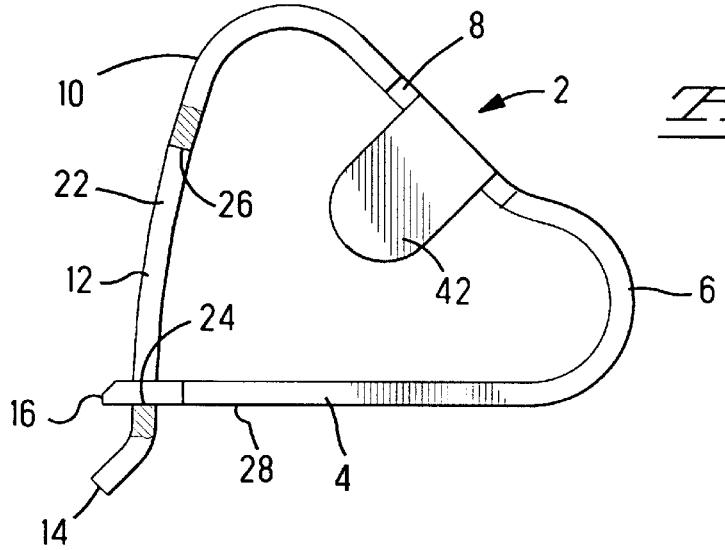
FIG. 2 is the same spring clamp as that of FIG. 1 but in a preassembled position.

The conductor receiving section 12 comprises an oblong cutout 22 extending along the strip. A portion of the base section 4 extending from the leading end 16 has a reduced width for insertion into the cutout 22 as shown in FIG. 2. The cutout 22 extends between a lower edge 24 and an upper edge 26, and in the preassembled position as shown in FIG. 2, the lower edge 24 abuts a lower surface 28 of the base section 4. In this position, the spring member is slightly prestressed. As shown in FIG. 3, the spring clamp terminal base section 4 can be mounted on a base plate 30 having an upwardly-bent leading end 32 and a serrated lower surface 34 at a wire clamping zone. The base plate leading end 32 also has a narrowed-down width such that it can be inserted through the cutout 12, whereby the cutout lower edge 24 resiliently abuts the serrated clamping surface 34 when mounted thereto.

Referring to FIG. 4, the spring clamp is shown with the actuation section 10 fully depressed such that the cutout 22 extends below the serrated clamping surface 34 for receiving inner conducting strands 36 of a conductor 38 therethrough. Upon releasing depression of the actuation section 10, resiliency of the spring section 6 causes the conducting strands 36 to be clamped between the cutout lower edge 24 and the serrated clamping surface 34. Sharp edges of the serrated surface and of corner 40 of the cutout lower edge 24 dig into the conducting strands 36 for good electrical contact thereto, as well as secure retention thereof in opposition to tensile forces along the wire conductor 38.

The embodiment of FIGS. 1–5 further comprises an anti-overstress member 42 which is a tab extending substantially orthogonally from a side 20 of the overhead lever arm section 8 between the actuation and spring sections 10, 6 respectively. The spring clamp lateral edge 20 has a recess 44 where the anti-overstress member 42 is attached such that an abutment end 46 of the tab 42 is overhead the base section 4, and thus abuts thereagainst when the actuation section 10 is fully depressed as shown in FIG. 4. The abutment end 46 is arcuate in shape. In order to provide a stronger abutment feature, a second anti-overstress member can be provided extending from the other lateral edge 18 of the spring clamp member as shown in FIG. 5.

Figure 9:
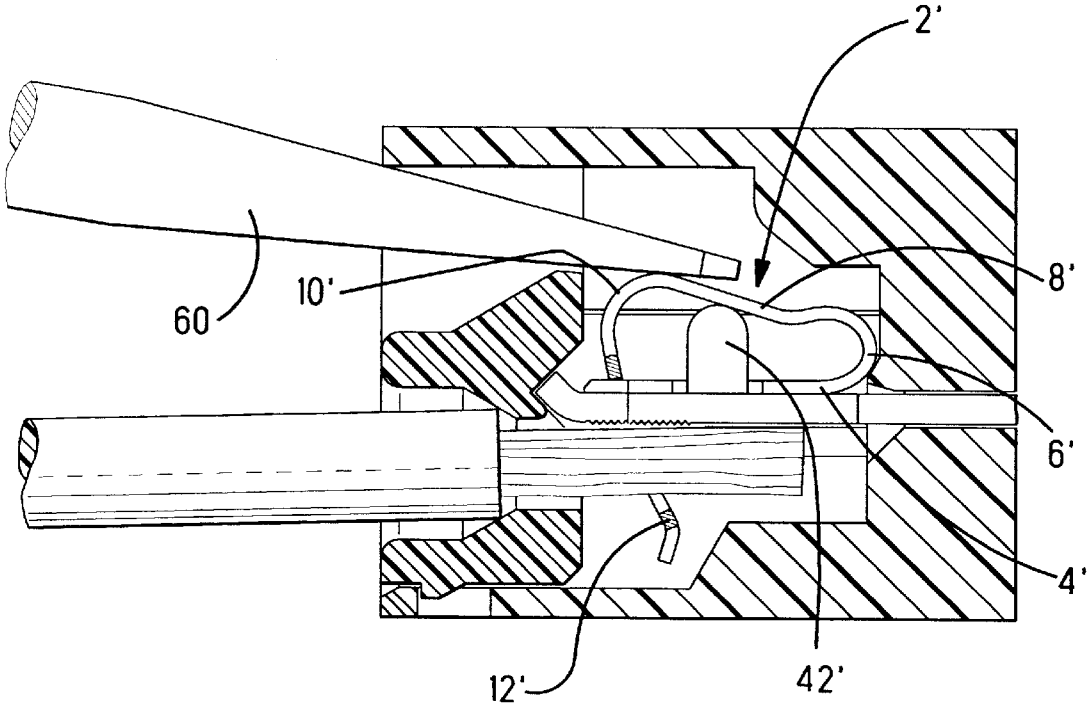
FIG. 9 is a view similar to that of FIG. 7 but with another spring clamp embodiment according to this invention.

Referring to FIG. 9, another anti-overstress member 42' is shown which is similar to the anti-overstress member 42 of FIGS. 1–5, but extends from the base section 4' rather than from the overhead lever arm section 8'. All similar features of this embodiment are denoted with the same numbering of that of FIGS. 1–5, but with a prime.

Figure 6:
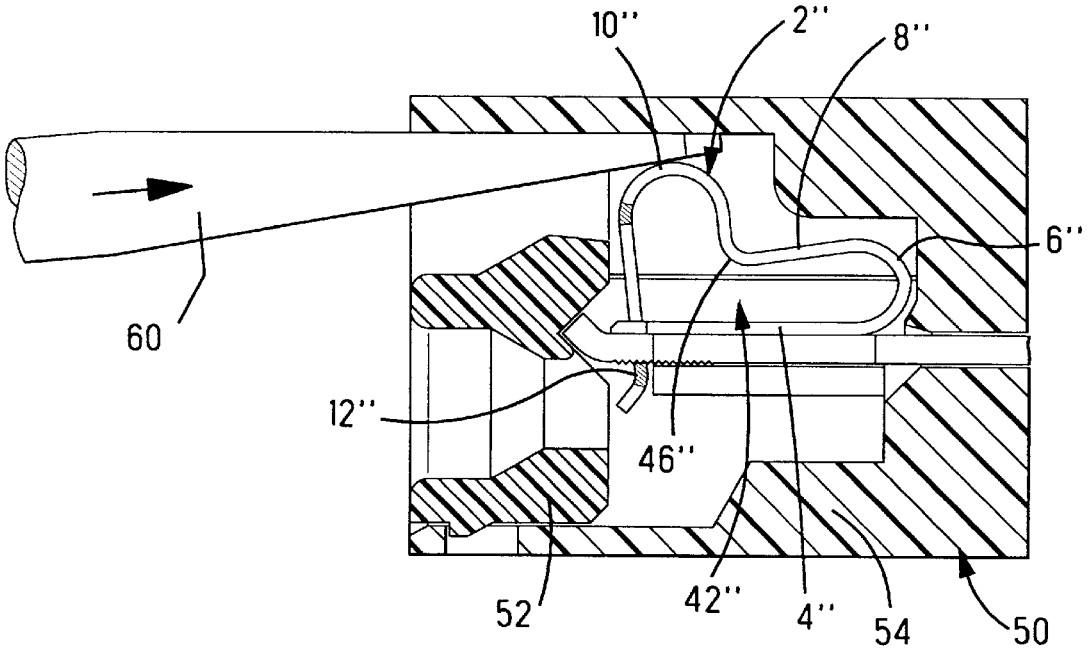
FIGS. 6–8 show cross-sectional views through part of a connector receiving another embodiment of a spring clamp terminal according to this invention, where the figures show various steps in connecting the spring clamp to a conducting wire.
Figure 7:
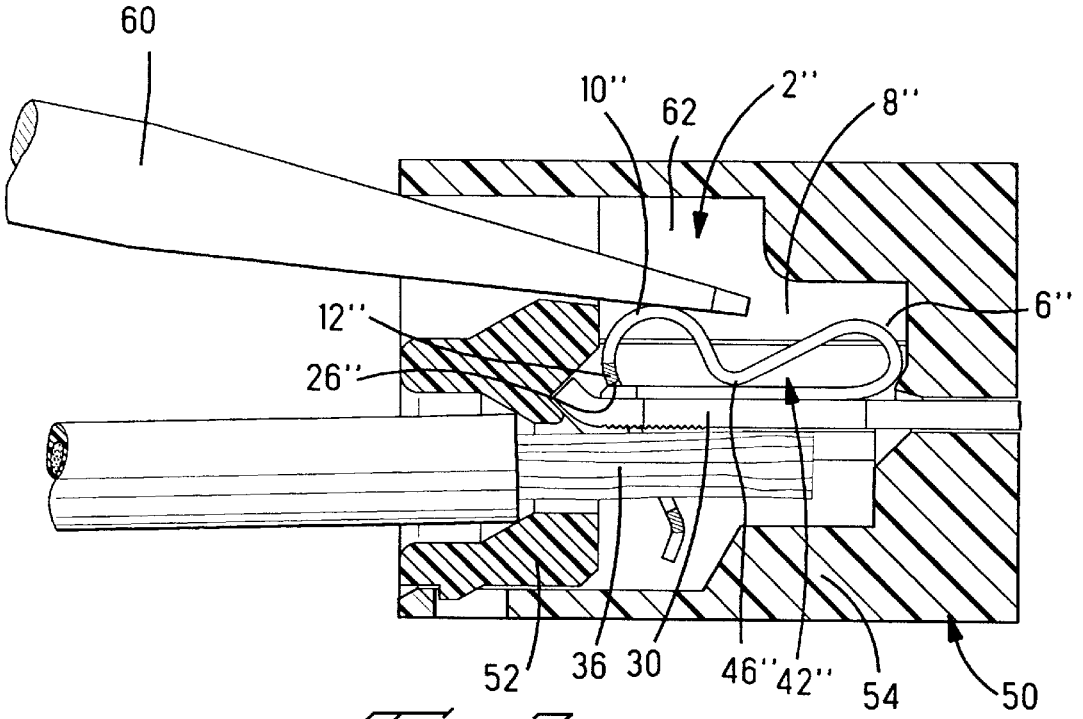
Figure 8:
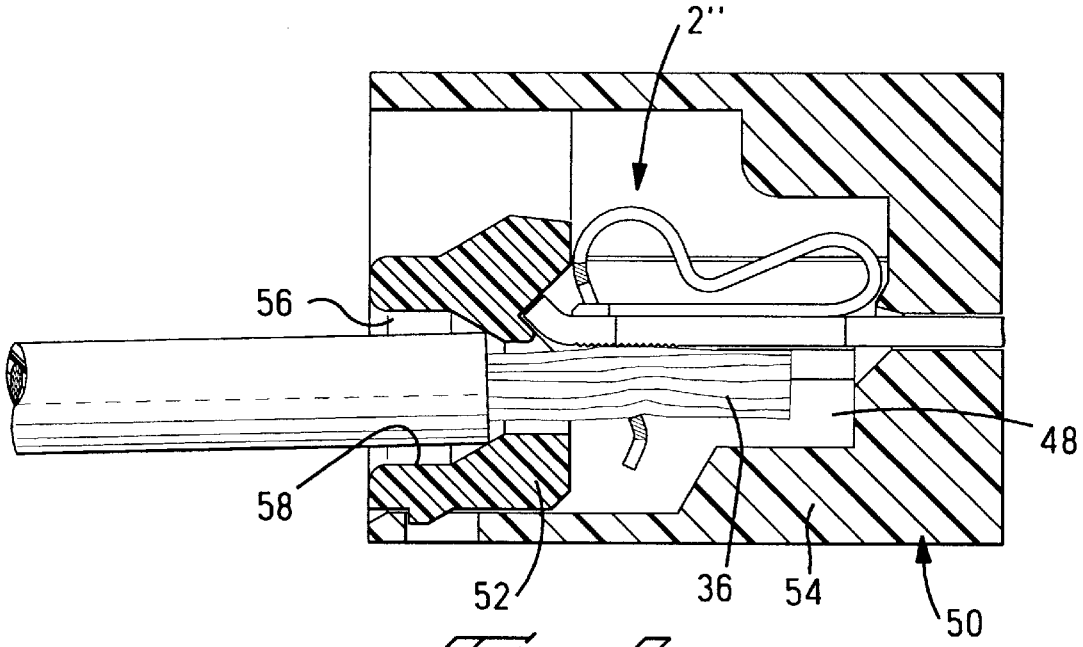

Referring now to FIGS. 6 to 8, another embodiment of a spring clamp 2" is shown mounted within a cavity 48 of a connector insulative housing 50 which is only partially shown here. The connector housing 50 further comprises a coverpart 52 latched to a main housing 54 at a conductor receiving end 56 of the cavity 48. This coverpart 52 has inwardly tapered cavities 58 extending therethrough for guiding the conductor 36 therein for connection to the spring clamp terminal 2". The coverpart 52 also serves as a means for retaining and securely positioning the spring clamp terminal 2" within the housing cavity 48. The spring clamp terminals of FIGS. 1–5, or 9 could of course also be mounted in a similar way to the housing as described hereabove.

The spring clamp terminal 2" comprises many similar features to the spring clamp terminals of FIGS. 1–5 and 9 except for the anti-overstress member denoted 42" in this embodiment. The anti-overstress member 42" is formed directly from the overhead lever arm section 8" that extends between the actuation section 10" and the U-shaped spring section 6". The anti-overstress member 42" is V-shaped to comprise an abutment end 46" from which extend two arms towards the actuation and spring sections 10", 6" respectively, the arms forming an angle of roughly 90° with respect to each other. The arms could of course be at many different angles with respect to each other, the important feature being to provide a substantial protrusion indented from the overhead lever arm 8" such that the abutment surface 46" resulting therefrom prevents over-deformation of the spring section 6", such deformation being limited to what is shown in FIG. 7, for example. Although the upper edge 26" of the cutout 22" limits depression of the actuation section 10", a tool such as a screwdriver 60 may be inserted too far into a section 62 of the cavity 48 above the spring clamp and pressed down on the lever arm or even on the spring section and cause over-deformation of the spring section 6". Positioning of an anti-overstress member 46, 46', 46" intermediate the actuation and spring sections thus provides a reliable anti-overstress feature for the spring section.

The connection of a conductor to the spring clamp terminal 2" of the connector 50 is illustrated in FIGS. 6 to 8. In FIG. 6 a tool such as the screwdriver 60 is inserted into the cavity area 62 above the actuation section 10" of the spring clip, the screwdriver then being pivoted as shown in FIG. 7 such that the tip section of the screwdriver depresses the actuation section 10" until abutment of the abutment end 46" of the anti-overstress member against the opposing side of the spring clip terminal. The conductor 36 can thus be inserted through the portion of the cutout 22" extending below the base plate 30. The screwdriver can then be removed to allow upward biasing of the conductor receiving section 12 for clamping the wire against the base plate.

Advantageously therefore, integral forming of an anti-overstress member proximate the spring clamp terminal spring section prevents over-deformation thereof, in a cost-effective, robust and reliable manner.

I/We claim:

1. A screwless clamping terminal stamped and formed from sheet metal comprising a base section, a U-shaped spring section, an overhead lever arm section, and actuation section and a conductor receiving section, these sections attached successively together and shaped such that the spring, overhead arm, actuation and conductor receiving sections loop over an upper surface of the base section, the conductor receiving section comprising a cutout receiving a leading end of the base section therethrough remote from the spring section to receive conductors therethrough aligned with the base section, the conductor receiving section resiliently biasable by depressing the actuation section towards the base section to enlarge the conductor receiving area of the cutout below the leading edge for reception of a conductor therethrough, wherein the clamping terminal comprises an anti-overstress member integral therewith and positioned in a mid-section between the conductor receiving and spring sections for limiting bending of the spring section, the anti-overstress member comprising a protrusion extending between the base section and the overhead lever arm section and joined to one thereof and abuttable against the other thereof spaced from the conductor receiving section upon actuation section depression.

2. The terminal of claim 1 characterized in that the antioverstress member is U-shaped with legs of the U-shape directed towards the base section.

3. The terminal of claim 1 characterized in that the anti-overstress member is formed as a V-shaped bulge in the overhead lever arm section.

4. The terminal of claim 3 characterized in that the V-shaped anti-overstress member has one arm extending to the actuation section, and another arm extending to the spring section, the arms forming an angle of roughly 90° between them.

5. The terminal of claim 1 characterized in that the anti-overstress member comprises a tab bent substantially orthogonally to the base section from a lateral edge of the terminal.

6. The terminal of claim 5 characterized in that the tab extends from the base section.

7. The terminal of claim 5 characterized in that the tab extends from the overhead lever-arm section.

8. The terminal of claim 5 characterized in that the tab has a rounded abutment edge for abutting the opposite surface of the spring clamp when the actuation section is depressed fully.

9. The terminal of claim 5 characterized in that there are a pair of the tabs disposed on opposite lateral edges of the spring clamp terminal.

10. In a screwless clamping terminal stamped and formed from sheet metal having in succession a base section, a U-shaped spring section, an overhead lever arm section, an actuation section and a conductor receiving section, where the sections are shaped such that the spring, overhead arm, actuation and conductor receiving sections loop over an upper surface of the base section, the conductor receiving section comprising a cutout receiving a leading end of the base section therethrough remote from the spring section and overhead arm, the conductor receiving section being resiliently biased at least toward the base section when unactuated and being relatively deflectable transversely with respect to the base section by depressing the actuation section towards the base section to enlarge the wire receiving area of the cutout below the leading end for reception of a conductor therethrough, the improvement comprising an anti-overstress member integral with the clamping terminal and positioned in a mid-section between the conductor receiving and spring sections for limiting bending of the spring section, the anti-overstress member comprising at least one protrusion extending between the base section and overhead lever arm section and joined to one thereof and abuttable against the other thereof spaced from the conductor receiving section upon full actuation section depression.

* * * * *